US008397582B2

(12) United States Patent
Zenoni et al.

(10) Patent No.: US 8,397,582 B2
(45) **Date of Patent: *Mar. 19, 2013**

(54) METHOD FOR DETECTING THE STOP OF THE YARN UNWINDING FROM A YARN FEEDER PROVIDED WITH A STATIONARY DRUM

(75) Inventors: Pietro Zenoni, Leffe (IT); Giovanni Pedrini, Leffe (IT); Luca Gotti, Albino (IT)

(73) Assignee: L.G.L. Electronics S.p.A., Gandino (IT)

( * ) Notice: Subject to any disclaimer, the term of this patent is extended or adjusted under 35 U.S.C. 154(b) by 357 days.

This patent is subject to a terminal disclaimer.

(21) Appl. No.: 12/801,762

(22) Filed: Jun. 24, 2010

(65) Prior Publication Data

US 2011/0000306 A1 Jan. 6, 2011

(30) Foreign Application Priority Data

Jul. 3, 2009 (EP) ..... 09 425 262

(51) Int. Cl.
*G01N 19/06* (2006.01)

(52) U.S. Cl. ..... 73/783

(58) Field of Classification Search ..... 73/783
See application file for complete search history.

(56) References Cited

U.S. PATENT DOCUMENTS

| | | | | |
|---|---|---|---|---|
| 4,386,508 | A * | 6/1983 | Jacobsson | 66/132 T |
| 4,768,565 | A | 9/1988 | Tholander | |
| 5,050,405 | A | 9/1991 | Jacobsson | |
| 5,323,324 | A * | 6/1994 | Fredriksson | 700/130 |
| 5,590,547 | A * | 1/1997 | Conzelmann | 66/132 R |
| 6,321,576 | B1 | 11/2001 | Barea | |
| 2012/0031148 | A1 * | 2/2012 | Zenoni et al. | 66/163 |

FOREIGN PATENT DOCUMENTS

| | | |
|---|---|---|
| EP | 1335054 | 8/2003 |

* cited by examiner

*Primary Examiner* — Lisa Caputo
*Assistant Examiner* — Octavia Davis-Hollington
(74) *Attorney, Agent, or Firm* — Modiano & Associati; Albert Josif; Daniel J. O'Byrne

(57) ABSTRACT

In order to detect the stop of the yarn unwinding from a yarn feeder provided with a stationary drum and with a sensor generating a pulse per each yarn loop unwound from the drum, a threshold time interval is continuously computed, which corresponds to the maximum interval between two successive pulses, above which it should be regarded that an accidental stop of the yarn has occurred. The threshold time interval is updated in real time as a function of the yarn-drawing speed. Then the delay from the last pulse is continuously measured and compared with the updated threshold time interval. The machine is stopped when the measured delay overcomes the updated threshold interval.

9 Claims, 1 Drawing Sheet

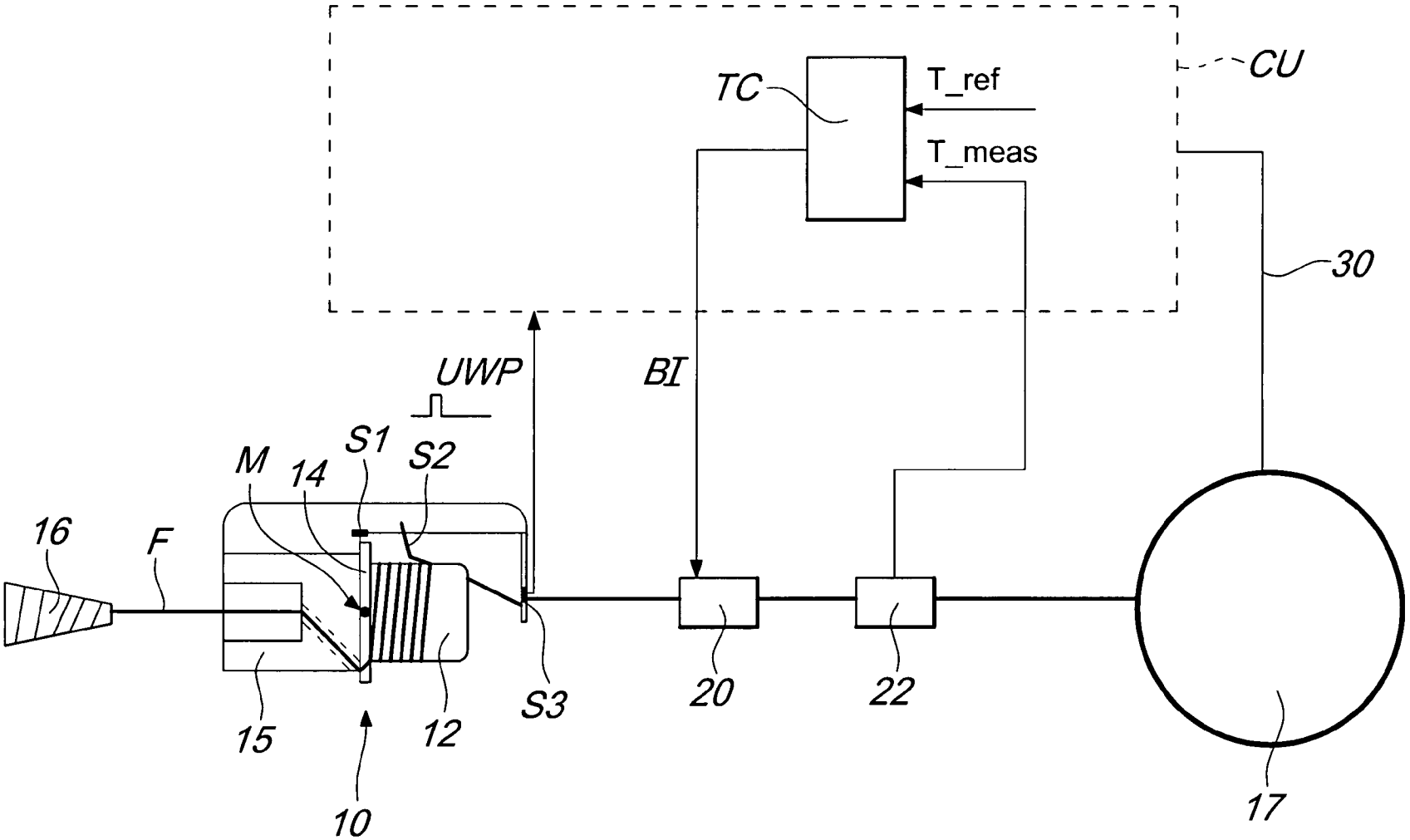
CU
30
17
T_ref
T_meas
TC
22
20
BI
S3
UWP
S2
12
S1
10
14
M
15
F
16

METHOD FOR DETECTING THE STOP OF THE YARN UNWINDING FROM A YARN FEEDER PROVIDED WITH A STATIONARY DRUM

The present invention relates to a method for detecting the stop of the yarn unwinding from a yarn feeder provided with a stationary drum, particularly for knitting machines.

BACKGROUND OF THE INVENTION

Yarn-feeders are known, which comprise a stationary drum on which a motorized flywheel winds a plurality of yarn loops forming a weft stock. Upon request from a downstream machine, typically a circular/rectilinear knitting machine of a conventional type, the loops are unwound from the drum, then pass through a weft-braking device which controls the tension of the yarn, and finally are fed to the machine.

The yarn feeders of the above type are well-known to the person skilled in the art and have the main aim of maintaining the amount of yarn stored on the drum substantially constant apart from the yarn-drawing speed of the downstream machine, while minimizing the tension of the delivered yarn. To this purpose, the yarn feeder is provided with various sensors connected to a control unit. One of these sensors, in particular, generates at least one pulse per each unwound loop and may be, e.g., an optical sensor, a piezoelectric sensor, and the like. This sensor cooperates with the other sensors to optimize the yarn-winding speed of the flywheel in order to maintain the amount of yarn stored on the drum constant.

With the conventional systems, another sensor is arranged between the feeder and the knitting machine for detecting the stop of the yarn, which circumstance may occur in case of breaking of the yarn or unhooking of the yarn from the needles of the machine. In this case, the control unit commands the stop of the machine in order to prevent defects in the finished article and to avoid the weft tube of the article under processing to detach, which circumstance, as known, requires the laborious, time-consuming operation of re-inserting the yarns forming the article into the machine.

As known, the above yarn-breaking sensors may be either mechanical or electronic.

The advantage of the mechanical sensors is that they are less expensive, but they are less effective in terms of quickness of response; moreover, in operation, they graze the yarn by a sensing arm, thereby interfering with the yarn-feeding tension and consequently affecting the accuracy of the tension-controlling system.

The advantage of the electronic sensors is that they are more effective in terms of quickness of response and, in operation, they do not interfere with the tension of the unwinding yarn because the motion of the yarn is detected by a photoelectric sensor. However, these electronic sensors are very expensive and they need installing and wiring an additional supplying/communication circuit, with consequent rise in costs and in the complexity of the detecting system.

SUMMARY OF THE INVENTION

Therefore, it is the aim of the present invention to provide a method for detecting the stop of the yarn unwinding from a yarn feeder provided with a stationary drum, which overcomes the drawbacks rising from the use of dedicated sensors such as the above mentioned ones.

The above aim and other objects, which will better appear below, are achieved by the method having the features recited in claim 1, while the dependent claims state other advantageous, though secondary, features of the invention.

BRIEF DESCRIPTION OF THE DRAWINGS

The invention will be now described in more detail with reference to a few preferred, non-exclusive embodiments, disclosed by way of non-limiting example with reference to FIG. 1, wherein a block diagram shows a yarn-feeding apparatus for carrying out the method according to the invention.

DESCRIPTION OF THE PREFERRED EMBODIMENTS

With reference to FIG. 1, a yarn feeder 10 for textile machines comprises a stationary drum 12 and a flywheel 14 driven by a motor 15, which draws yarn F from a reel 16 and winds it on a drum 12 in form of loops, thereby forming a weft reserve or stock. Upon request from a general textile machine, advantageously a knitting machine 17, yarn F is unwound from drum 12 and is fed to the machine.

The amount of yarn stored on drum 12 is controlled by a triad of sensors. A first sensor S1, typically a Hall sensor, detects the passing of magnets such as M attached to flywheel 14, in order to calculate the amount of yarn wound on the drum, as well as the winding speed. A second sensor S2, preferably a mechanical sensor, provides a binary information indicative of the presence or absence of a minimum amount of stock on an intermediate area of drum 12. A third sensor S3, preferably an optical sensor, generates a pulse UWP per each loop unwound from the drum.

A weft-braking device 20 is arranged downstream of yarn-feeder 10 and is controlled by a control unit CU that is programmed to control the tension of the yarn unwinding from drum 12 in order to maintain it substantially constant. A tension sensor 22 is arranged downstream of weft-braking device 20 for measuring the tension of yarn F unwinding from the drum and for generating a corresponding measured tension signal T_meas.

Control unit CU comprises a tension control block TC which is programmed to compare measured tension signal T_meas with a reference tension T-ref indicative of a desired tension, and to generate a braking signal BI that drives weft-braking device 20 to modulate the braking intensity, in such a way as to minimize the difference between the measured tension and the reference tension.

Control unit CU conventionally communicates with knitting machine 17 via a bus 30 for mutually exchange data such as alarm signals, states and programming of parameters.

Unlike the conventional feeding lines, in order to detect the possible condition of breaking of the yarn the apparatus above employs a method that, according to the invention, does not require dedicated sensors because it makes use of the pulse signals UWP generated by third sensor S3.

In particular, as mentioned above, during normal operation the feeder receives a pulse UWP from sensor S3 per each loop unwound from drum 12. As well known to the person skilled in the art, the yarn-drawing speed remains substantially constant at a certain operating speed of the downstream machine, so that these pulses are substantially equally-spaced over time, i.e., the time intervals between successive pulses may only vary of negligible amounts. In the light of this, the method according to the invention is based on the principle that, when the delay from the last pulse is considerably longer than the average time interval between two pulses, it means that the yarn has accidentally stopped due to either breaking of the yarn or unhooking of the yarn from the needles of machine 17.

In a first embodiment of the invention, which is suitable to the case that only the state information (RUN/STOP), i.e., not the operative speed, of machine 17 is available, the method according to the invention is enabled only when the machine is operative and comprises the following steps:

the average time interval MUT between two successive pulses (i.e., the average loop-unwinding time) is continuously computed and, from the latter, a threshold time interval MWT is computed corresponding to the maximum interval above which it should be regarded that an accidental stop of the yarn has occurred, this threshold interval being updated in real time according to the formula:

$$MWT=MUT*K,$$

wherein K is a constant preferably in the range 2 to 4, the delay DT from the last pulse UWP is continuously measured and compared with the updated threshold interval MWT, when delay DT overcomes the updated threshold interval MWT, the machine is stopped.

Of course, all the above measuring/computing operations are performed by control unit CU on the basis of the pulse signals received from sensor S3. The programming of the control unit falls within the normal knowledge of the person skilled in the art and, accordingly, it will not be further discussed.

Advantageously, average loop-unwinding time MUT is computed as arithmetic mean of the last n intervals $UT_1$, $UT_2$, . . . , $UT_n$, where n is preferably in the range 3 to 5.

With this embodiment, in which the information of the operative speed of the machine is not available, threshold interval MWT is updated depending on the changes in the average time interval between two successive pulses, which changes depend on the yarn drawing speed.

According to an alternative embodiment of the invention, which is suitable to the case that both the state information and the operative speed of the machine are available, the detecting method is preceded by a tuning operation which comprises the following steps:

the machine is operated at a nominal operative speed SPD0 and the average time interval MUT0 between two successive pulses is calculated at nominal operative speed SPD0, a nominal threshold time interval MWT0 is computed according to the formula:

$$MWT0=MUT0*K'$$

wherein K' is a constant preferably in the range 2 to 4, and nominal threshold interval MWT0 and nominal operative speed SPD0 of the machine are stored.

Once performed the above tuning operation, the method according to this alternative embodiment comprises the following steps:

the threshold time interval updated in real time is continuously computed according to the formula:

$$MWT'=MWT0*SPD0/SPD,$$

wherein MWT' is the updated threshold interval and SPD is the operative speed updated in real time of the machine, delay DT' from the last pulse UWP is continuously measured and compared with the updated threshold interval MWT', when delay DT' overcomes the updated threshold interval MWT', the machine is stopped.

Likewise the previous embodiment, average time interval MUT0 between two successive pulses at the nominal operative speed SPD0 is advantageously computed as arithmetic mean of the last m intervals $UT_1$, $UT_2$, . . . , $UT_m$, where m is preferably in the range 3 to 5.

With the machine at rest, the value of SPD is equal to 0 and the control unit disables the detecting method; this circumstance corresponds to set threshold time interval MWT to infinity.

With this embodiment, the average time interval between two successive pulses is only calculated during the tuning operation and, since the information of the operative speed of the machine is available, the threshold time interval is directly updated as a function of the operative speed of the machine, from which the yarn-drawing speed depends.

Therefore, with both the above embodiments the threshold time interval is continuously updated as a function of the yarn-drawing speed. With the first embodiment the operative speed of the downstream machine is not available, whereby the average time interval between successive pulses is used as a parameter for updating the threshold time interval. With the second embodiment the operative speed of the machine is available, whereby this information is used.

A few preferred embodiments of the invention have been described herein, but of course many changes may be made by a person skilled in the art within the scope of the claims. In particular, although only one sensor S3 is present in the above-described preferred embodiments, whereby only one pulse is generated per each loop unwound from the drum, the invention is similarly applicable in the case that a plurality of equally-spaced sensors are provided, whereby a plurality of pulses are generated per each loop unwound from the drum. The disclosures in European Patent Application No. 09425262.4 from which this application claims priority are incorporated herein by reference.

What is claimed is:

1. A method for detecting the stop of the yarn unwinding from a yarn feeder to a downstream machine, said yarn feeder being provided with a stationary drum and with a sensor arranged to generate a pulse per each yarn loop unwound from the drum, wherein the method comprises the steps of:

continuously computing a threshold time interval, corresponding to the maximum interval between two successive pulses, above which it should be regarded that an accidental stop of the yarn has occurred, said threshold time interval being updated in real time as a function of the yarn-drawing speed, continuously measuring the delay from the last pulse and comparing it with said updated threshold time interval, and stopping said downstream machine when said measured delay overcomes said updated threshold interval.

2. The method of claim 1, wherein said threshold time interval is calculated on the basis of the formula:

$$MWT=MUT*K,$$

in which MWT is said threshold time interval, MUT is said average time interval between two successive pulses updated in real time, and K is a predetermined constant.

3. The method of claim 2, wherein said constant K is in the range 2 to 4.

4. The method of claim 2, wherein said average time interval between successive pulses is calculated as arithmetic mean of the last n intervals.

5. The method of claim 4, wherein n is in the range 2 to 5.

6. The method of claim 1, comprising a preliminary tuning operation comprising the following steps:

operating the machine at a nominal operative speed and calculating the average time interval between two successive pulses at said nominal operative speed, calculate a nominal threshold time interval according to the formula:

$$MWT0=MUT0*K',$$

wherein MWT0 is said nominal threshold time interval, MUT0 is said average time interval between two successive pulses at the nominal speed, and K' is a predetermined constant, and in that said threshold time interval is calculated according to the formula:

$$MWT'=MWT0*SPD0/SPD$$

wherein MWT' is the calculated threshold time interval, SPD0 is said nominal operative speed, and SPD is the operative speed updated in real time,

7. The method of claim 6, wherein said constant K' is in the range 2 to 4.

8. The method of claim 6, wherein said average time interval between two successive pulses at said nominal speed is calculated as arithmetic mean of the last m intervals.

9. The method of claim 8, wherein m is in the range 2 to 5.

* * * * *